US009580843B2

(12) United States Patent
Okuya et al.

(10) Patent No.: US 9,580,843 B2
(45) Date of Patent: Feb. 28, 2017

(54) CLOTH AND TEXTILE PRODUCT

(71) Applicant: TEIJIN LIMITED, Osaka-shi, Osaka (JP)

(72) Inventors: Tomohiro Okuya, Ibaraki (JP); Hiroki Shimada, Ibaraki (JP); Saori Kuroda, Ibaraki (JP)

(73) Assignee: TEIJIN LIMITED, Osaka (JP)

( * ) Notice: Subject to any disclaimer, the term of this patent is extended or adjusted under 35 U.S.C. 154(b) by 0 days.

(21) Appl. No.: 14/782,617

(22) PCT Filed: Jun. 10, 2014

(86) PCT No.: PCT/JP2014/065302

§ 371 (c)(1),
(2) Date: Oct. 6, 2015

(87) PCT Pub. No.: WO2014/199969

PCT Pub. Date: Dec. 18, 2014

(65) Prior Publication Data

US 2016/0040326 A1 Feb. 11, 2016

(30) Foreign Application Priority Data

Jun. 11, 2013 (JP) ..... 2013-122758

(51) Int. Cl.

| | |
|---|---|
| ***D03D 15/12*** | (2006.01) |
| ***D03D 15/00*** | (2006.01) |
| ***D04B 1/16*** | (2006.01) |
| ***D02G 3/44*** | (2006.01) |
| ***D03D 15/08*** | (2006.01) |

(52) U.S. Cl.

CPC ..... *D03D 15/12* (2013.01); *D02G 3/443* (2013.01); *D03D 15/0027* (2013.01); *D03D 15/08* (2013.01); *D04B 1/16* (2013.01)

(58) Field of Classification Search

CPC ..... D02G 3/443; D02G 3/047; D02G 3/38; D02G 3/28; D02G 3/185; D02G 3/441; D02G 1/02; D02G 1/165; D02G 1/20; D02G 3/02; D02G 3/04; D03D 15/12; D03D 15/0027; D03D 15/00; D03D 1/0035

See application file for complete search history.

(56) References Cited

U.S. PATENT DOCUMENTS

| | | | | |
|---|---|---|---|---|
| 4,196,118 | A * | 4/1980 | Fujie | C08K 5/521 264/178 F |
| 5,356,700 | A * | 10/1994 | Tanaka | D02G 3/047 139/420 R |
| 5,496,625 | A * | 3/1996 | Lilani | A41D 31/0027 428/377 |
| 6,410,140 | B1 * | 6/2002 | Land | D01D 5/22 428/369 |
| 6,553,749 | B2 * | 4/2003 | Land | D02G 3/185 57/5 |
| 6,667,097 | B2 * | 12/2003 | Tokarsky | D01D 4/00 428/364 |
| 6,701,703 | B2 * | 3/2004 | Patrick | D02G 3/12 57/211 |
| 6,919,130 | B2 * | 7/2005 | Tokarsky | D01D 4/00 428/357 |
| 7,537,830 | B2 * | 5/2009 | Zhu | D02G 3/443 428/136 |
| 2002/0124544 | A1 * | 9/2002 | Land | D02G 3/185 57/5 |
| 2004/0035489 | A1 * | 2/2004 | Thiriot | A41D 31/00 139/420 R |
| 2004/0062912 | A1 * | 4/2004 | Mason | D04H 1/46 428/139 |
| 2005/0025962 | A1 * | 2/2005 | Zhu | D02G 3/047 428/359 |
| 2005/0118919 | A1 * | 6/2005 | Link | D04H 1/46 442/414 |
| 2006/0048497 | A1 * | 3/2006 | Bloch | D02G 3/06 57/230 |

(Continued)

FOREIGN PATENT DOCUMENTS

| | | | |
|---|---|---|---|
| CN | 101748549 | A | 6/2010 |
| JP | 2001-248027 | A | 9/2001 |
| JP | 2003-119635 | A | 4/2003 |
| JP | 2003-193314 | A | 7/2003 |
| JP | 2003-221744 | A | 8/2003 |
| JP | 2005-307429 | A | 11/2005 |
| JP | 2006-124865 | A | 5/2006 |
| JP | 2007-009378 | A | 1/2007 |
| JP | 2008-190103 | A | 8/2008 |
| JP | 2009-197361 | A | 9/2009 |

OTHER PUBLICATIONS

International Search Report for PCT/JP2014/065302 dated Sep. 16, 2014.

Communication dated Jun. 20, 2016 from the European Patent Office in counterpart application No. 14811101.6.

Communication dated Jul. 21, 2016 from the European Patent Office in counterpart application No. 14811101.6.

*Primary Examiner* — Bobby Muromoto, Jr.
(74) *Attorney, Agent, or Firm* — Sughrue Mion, PLLC

(57) ABSTRACT

The present invention addresses the problem of providing a cloth that is excellent in terms of not only flame retardancy but also stretchability, and also a textile product using the cloth. As a means for resolution, a composite yarn is obtained using a spun yarn that contains a flame-retardant fiber having a limiting oxygen index of 25 or more as measured in accordance with JIS K7201 and a conjugate fiber that is made of two components put together in a side-by-side manner or an eccentric sheath-core manner, and then a cloth is obtained using the composite yarn, in which the weight proportion of the flame-retardant fiber is 75 wt % or more based on the weight of the cloth, and the weight proportion of the conjugate fiber is within a range of 5 to 15 wt % based on the weight of the cloth.

13 Claims, No Drawings

(56) References Cited

U.S. PATENT DOCUMENTS

2008/0033113 A1* 2/2008 Ieno ..... D06M 11/63 525/326.1
2009/0019614 A1* 1/2009 Hagihara ..... A41D 19/01529 2/16
2009/0053952 A1* 2/2009 Zhu ..... D01F 6/76 442/189
2009/0053954 A1* 2/2009 Zhu ..... D02G 3/443 442/302
2009/0053955 A1* 2/2009 Zhu ..... A41D 31/0027 442/302
2009/0053956 A1* 2/2009 Zhu ..... D02G 3/443 442/302
2009/0137176 A1* 5/2009 Okuya ..... A41D 31/0027 442/189
2010/0009186 A1* 1/2010 Zhu ..... D02G 3/047 428/395
2010/0205723 A1* 8/2010 Takahashi ..... A62B 17/003 2/458
2011/0138523 A1* 6/2011 Layson, Jr. ..... B32B 5/26 2/458
2012/0042442 A1* 2/2012 Takahashi ..... D03D 13/008 2/458
2012/0100386 A1* 4/2012 Honma ..... D02G 3/32 428/592
2012/0102632 A1* 5/2012 Zhu ..... A41D 31/0027 2/455
2012/0114940 A1* 5/2012 Kamada ..... D01D 5/34 428/373
2012/0159697 A1* 6/2012 Zhu ..... D02G 3/047 2/455
2012/0232211 A1* 9/2012 Vos ..... B32B 5/26 524/537
2013/0040523 A1* 2/2013 Takahashi ..... D02G 3/28 442/190
2013/0045653 A1* 2/2013 Takahashi ..... D02G 3/443 442/301
2013/0055490 A1* 3/2013 Zhu ..... D03D 13/004 2/458
2013/0081238 A1* 4/2013 Link ..... D04H 1/42 28/107
2013/0118635 A1* 5/2013 Layson, Jr. ..... D03D 15/0005 139/420 R
2014/0026303 A1* 1/2014 Zhu ..... A62B 17/003 2/458
2014/0187113 A1* 7/2014 Hines, Jr. ..... D03D 1/0035 442/199
2015/0159304 A1* 6/2015 Schmitt ..... D02G 3/443 442/199
2015/0167199 A1* 6/2015 Endo ..... D01F 6/92 525/425
2015/0191856 A1* 7/2015 Hines ..... D02G 3/443 428/221
2015/0299905 A1* 10/2015 Shimada ..... D01F 6/805 442/133
2016/0040326 A1* 2/2016 Okuya ..... D03D 15/08 139/420 R

* cited by examiner

CLOTH AND TEXTILE PRODUCT

TECHNICAL FIELD

The present invention relates a cloth that is excellent in terms of not only flame retardancy but also stretchability, and also to a textile product using the cloth.

BACKGROUND ART

As work clothes worn by people engaged in activities where they may be exposed to flames, such as firefighting and activities in electric power or chemical companies, clothes using a flame-retardant cloth have been used in the past. Such flame-retardant cloths use flame-retardant fibers such as meta-aramid fibers and para-aramid fibers. Further, it is said that such flame-retardant fibers generally have poor stretchability.

As methods for imparting stretchability to a cloth using a flame-retardant fiber, a method in which a cloth is formed using an elastic yarn together with a flame-retardant fiber (see, e.g., Patent Document 1, Patent Document 2, and Patent Document 3), a method in which a flame-retardant fiber is twisted, heat-set, and untwisted, and then a cloth is formed using the flame-retardant fiber (see, e.g., Patent Document 4, Patent Document 5, and Patent Document 6), etc., have been proposed.

However, with respect to a cloth using an elastic yarn, there have been problems with heat resistance, flame retardancy, chemical resistance, and the like. Meanwhile, with respect to a cloth using a flame-retardant fiber that has been twisted, heat-set, and untwisted, there have been problems in that its stretchability decreases during weaving, post processing, and wearing, and also the problem of increased cost.

PRIOR ART DOCUMENTS

Patent Documents

Patent Document 1: JP-A-2003-193314
Patent Document 2: JP-A-2006-124865
Patent Document 3: JP-A-2007-9378
Patent Document 4: JP-A-2001-248027
Patent Document 5: JP-A-2005-307429
Patent Document 6: JP-A-2008-190103

SUMMARY OF THE INVENTION

Problems that the Invention is to Solve

The invention has been accomplished against the above background. An object thereof is to provide a cloth that is excellent in terms of not only flame retardancy but also stretchability, and also a textile product using the cloth.

Means for Solving the Problems

The present inventors have conducted extensive research to solve the problems mentioned above. As a result, they have found that when a cloth is formed using a composite yarn including a spun yarn that contains a flame-retardant fiber and a conjugate fiber that is made of two components put together in a side-by-side manner or an eccentric sheath-core manner, and the weight proportions of the flame-retardant fiber and the conjugate fiber are within specific ranges, a cloth that is excellent in terms of not only flame retardancy but also stretchability can be obtained. As a result of further extensive research, they have accomplished the invention.

Thus, the invention provides "a cloth using a composite yarn including:

a spun yarn that contains a flame-retardant fiber having a limiting oxygen index of 25 or more; and a conjugate fiber that is made of two components put together in a side-by-side manner or an eccentric sheath-core manner, the cloth being characterized in that the weight proportion of the flame-retardant fiber is 75 wt % or more based on the weight of the cloth, and the weight proportion of the conjugate fiber is within a range of 5 to 15 wt % based on the weight of the cloth."

In this regard, it is preferable that the flame-retardant fiber is at least one fiber selected from the group consisting of meta-aramid fibers, para-aramid fibers, polyparaphenylene benzoxazole fibers, polybenzimidazole fibers, polyimide fibers, polyetherimide fibers, polyamideimide fibers, carbon fibers, polyphenylene sulfide fibers, polyvinyl chloride fibers, flame-retardant rayon, modacrylic fibers, flame-retardant acrylic fibers, flame-retardant polyester fibers, flame-retardant vinylon fibers, melamine fibers, fluorine fibers, flame-retardant wool, and flame-retardant cotton. It is also preferable that the spun yarn further contains at least one fiber selected from the group consisting of polyester fibers, nylon fibers, rayon fibers, polynosic fibers, lyocell fibers, acrylic fibers, vinylon fibers, cotton, hemp, and wool. It is also preferable that the spun yarn has a twist coefficient within a range of 2.5 to 4.5. It is also preferable that the two components forming the conjugate fiber are a combination selected from the group consisting of a combination of polytrimethylene terephthalate and polytrimethylene terephthalate, a combination of polytrimethylene terephthalate and polyethylene terephthalate, and a combination of polyethylene terephthalate and polyethylene terephthalate. It is also preferable that the conjugate fiber is a multifilament having a single-fiber fineness of 0.5 to 10.0 dtex and a total fineness of 20 to 200 dtex. It is also preferable that the composite yarn is a plied yarn or a covering yarn. It is also preferable that the cloth is a woven fabric or a knitted fabric. It is also preferable that the cloth is a woven fabric, and one of the warp and weft of the woven fabric includes the composite yarn including a spun yarn that contains a flame-retardant fiber having a limiting oxygen index of 25 or more and a conjugate fiber that is made of two components put together in a side-by-side manner or an eccentric sheath-core manner, while the other of the warp and weft includes a spun yarn that contains a flame-retardant fiber having a limiting oxygen index of 25 or more. It is also preferable that the cloth has an elongation within a range of 3 to 50% in the warp direction and/or weft direction. It is also preferable that the cloth has an elongation recovery of 70% or more in the warp direction and/or weft direction. It is also preferable that the cloth has a limiting oxygen index of 25 or more.

The invention also provides a textile product using the cloth mentioned above.

Advantage of the Invention

The invention provides a cloth that is excellent in terms of not only flame retardancy but also stretchability, and also a textile product using the cloth.

MODE FOR CARRYING OUT THE INVENTION

Hereinafter, embodiments of the invention will be described in detail.

The composite yarn in the invention includes a spun yarn and a conjugate fiber. The spun yarn contains a flame-retardant fiber having a limiting oxygen index (hereinafter sometimes referred to as "LOI") of 25 or more (hereinafter sometimes simply referred to as "flame-retardant fiber"). Incidentally, the limiting oxygen index is measured in accordance with JIS K7201.

Examples of such flame-retardant fibers include meta-aramid fibers, para-aramid fibers, polyparaphenylene benzoxazole fibers, polybenzimidazole fibers, polyimide fibers, polyetherimide fibers, polyamideimide fibers, carbon fibers, polyphenylene sulfide fibers, polyvinyl chloride fibers, flame-retardant rayon, modacrylic fibers, flame-retardant acrylic fibers, flame-retardant polyester fibers, flame-retardant vinylon fibers, melamine fibers, fluorine fibers, flame-retardant wool, and flame-retardant cotton. At least one of these flame-retardant fibers may be used.

Among them, in terms of having an excellent limiting oxygen index and also of excellent mechanical properties, meta-aramid fibers, that is, metaphenylene isophthalamide fibers (commercially available products are "Conex"™ manufactured by Teijin Limited, "Nomex"™ manufactured by Du Pont, etc.) are preferable. Further, it is also preferable to mix para-aramid fibers, that is, paraphenylene terephthalamide fibers (commercially available products are "Twaron"™ manufactured by Teijin Limited, "Kevlar"™ manufactured by Du Pont-Toray Co. Ltd., etc.) and co-paraphenylene/3,4'-oxydiphenylene terephthalamide fibers (commercially available products are "Technora"™ manufactured by Teijin Limited, etc.)

As long as the object of the invention is not impaired, these flame-retardant fibers may also contain additives, such as antioxidants, UV absorbers, heat stabilizers, flame retarders, titanium oxide, colorants, and inert fine particles.

It is most preferable that the spun yarn is made only of the flame-retardant fiber, but non-flame-retardant fibers (fibers having a limiting oxygen index of less than 25) may also be contained. In this regard, examples of non-flame-retardant fibers include polyester fibers, nylon fibers, rayon fibers, polynosic fibers, lyocell fibers, acrylic fibers, vinylon fibers, cotton, hemp, and wool. At least one of these non-flame-retardant fibers may be used.

As long as the object of the invention is not impaired, these non-flame-retardant fibers may also contain additives, such as antioxidants, UV absorbers, heat stabilizers, flame retarders, titanium oxide, colorants, and inert fine particles.

In the flame-retardant fiber and the non-flame-retardant fiber, it is preferable that the fiber length is within a range of 35 to 110 mm.

The total fineness of the spun yarn may be suitably selected in consideration of surface appearance, heat resistance, heat protection, stretchability, texture, and the like according to the intended use. In particular, it is preferable that the spun yarn has a fineness within a range of 58 dtex (equivalent to a single yarn of English cotton count No. 100) to 580 dtex (equivalent to English cotton count No. 10).

In addition, in terms of excellent spinning-process passing properties and also of application to garments where flexibility is required, it is preferable that the spun yarn has a single-fiber fineness within a range of 0.6 to 5.5 dtex.

In terms of the physical properties and flexibility of the cloth, it is preferable that the spun yarn has a twist coefficient K within a range of 2.5 to 4.5. Here, $T=K\sqrt{n}$, T is the number of twists per inch (2.54 cm), n is an English cotton count, and K is a twist coefficient.

In addition, the spun yarn may be a single yarn or a two-ply yarn.

The conjugate fiber in the invention is made of two components put together in a side-by-side manner or an eccentric sheath-core manner. When the composite yarn contained in the cloth of the invention of the present application contains the conjugate fiber in addition to the above spun yarn, during the heat treatment of the cloth, the conjugate fiber takes a three-dimensional coil-like crimped configuration, whereby stretchability is imparted to the composite yarn, and, as a result, the cloth also has stretchability imparted.

Here, the two components forming the conjugate fiber may be a combination of polyester and polyester, a combination of polyester and nylon, or the like, for example. More specifically, preferred examples thereof include a combination of polytrimethylene terephthalate and polytrimethylene terephthalate, a combination of polytrimethylene terephthalate and polyethylene terephthalate, and a combination of polyethylene terephthalate and polyethylene terephthalate. In this regard, it is preferable that the two components have different intrinsic viscosities. It is also possible to add additives, such as antioxidants, UV absorbers, heat stabilizers, flame retarders, titanium oxide, colorants, and inert fine particles.

In the conjugate fiber, the shape of the fiber is not particularly limited, and it may be a long fiber (multifilament) or a short fiber. However, it order to obtain excellent stretchability, a long fiber (multifilament) is preferable.

The total fineness and single-fiber fineness of the conjugate fiber are suitably selected according to the intended use, and it is preferable that the total fineness is within a range of 20 to 200 dtex, and the single-fiber fineness is within a range of 0.5 to 10.0 dtex.

The composite yarn in the invention includes the above spun yarn and the above conjugate fiber. In this regard, in order to achieve flame retardancy and stretchability at the same time, it is preferable that the weight proportion of the conjugate fiber contained in the composite yarn is such that the weight proportion of the conjugate fiber is within a range of 2 to 40 wt % (more preferably 4 to 30 wt %, particularly preferably 4 to 20 wt %) based on the weight of the composite yarn.

Although the compositing method is not particularly limited, it is preferable that the composite yarn is a plied yarn or a covering yarn. More specifically, it is preferable that the spun yarn and the conjugate fiber are subjected to plying or covering using a commercially available uptwister, covering machine, Italian twisting machine, double twister, or the like. In this regard, twist-setting may be performed according to the required quality. The twist-setting of a composite plied yarn may be performed by vacuum steam setting commonly used for the setting of spun yarns. The temperature at the time of the setting of the composite plied yarn is preferably within a range of 50 to 95° C. (more preferably 50 to 85° C.). When the composite plied yarn twist-setting temperature is too high, the stretchability of the cloth finally obtained may be impaired.

The cloth of the invention is a cloth using the above composite yarn. In this regard, in order to obtain excellent flame retardancy, it is important that the weight proportion of the flame-retardant fiber is within a range of 75 wt % or more (preferably 75 to 95 wt %) based on the weight of the cloth. In this case, the non-flame-retardant fiber weight proportion is less than 25 wt %. In the case where the weight proportion of the flame-retardant fiber is less than 75 wt % based on the weight of the cloth, this may result in a decrease in flame retardancy and thus is undesirable.

In addition, it is important that the weight proportion of the conjugate fiber is within a range of 5 to 15 wt % based on the weight of the cloth. In the case where the weight proportion of the conjugate fiber is more than 15 wt % based on the weight of the cloth, a flame is easily transmitted along the conjugate fiber. This results in increased flammability and thus is undesirable. In addition, in the opposite case where the weight proportion of the conjugate fiber is less than 5 wt %, this may result in a decrease in stretchability and thus is undesirable.

The cloth structure of the cloth is not particularly limited, but is preferably a woven fabric or a knitted fabric.

In the case of a woven fabric, plain weaving, twill weaving, and satin weaving can be mentioned, for example. In the case of a knitted fabric, machine knitting, crocheting, needle knitting, Afghan knitting, and lace knitting can be mentioned, for example. For example, in the case of a woven fabric, the composite yarn may be 100% used in the warp direction and/or weft direction, and it is also possible that the spinning and the composite yarn are used in a ratio of 1:1, 2:1, 3:1, 1:2, or 1:3, for example. Incidentally, the method for knitting or weaving is not particularly limited, and may be a method using an ordinary knitting machine or weaving machine.

Here, it is preferable that the cloth is a woven fabric, and one of the warp and weft of the woven fabric includes the composite yarn including a spun yarn that contains a flame-retardant fiber having a limiting oxygen index of 25 or more and a conjugate fiber that is made of two components put together in a side-by-side manner or an eccentric sheath-core manner, while the other includes a spun yarn that contains a flame-retardant fiber having a limiting oxygen index of 25 or more.

Next, the cloth is subjected to a heat treatment, such as scouring, relaxing, dyeing, or setting. As a result, the conjugate fiber contained in the cloth, which is made of two components put together in a side-by-side manner or an eccentric sheath-core manner, takes a three-dimensional coil-like crimped configuration, whereby stretchability is imparted to the cloth.

The cloth may be additionally subjected to water-absorbing processing, water-repellent processing, napping, flame-retarding, UV shielding, or other various function-imparting processes using an antimicrobial, a deodorant, an insect repellent, a phosphorescent agent, a retroreflective agent, a minus ion generator, etc.

The cloth thus obtained contains the above composite yarn, and thus is excellent in terms of not only flame retardancy but also stretchability.

Here, as stretchability, it is preferable that the cloth has an elongation within a range of 3 to 50% in the warp direction and/or weft direction. In addition, as elongation recovery, it is preferable that the cloth has an elongation recovery of 70% or more (more preferably 73% to 99%) in the warp direction and/or weft direction. In addition, as flame retardancy, it is preferable that the cloth has a limiting oxygen index of 25 or more (more preferably 25 to 40) as measured in accordance with JIS K7201.

Next, the textile product of the invention uses the above cloth. The textile product uses the above cloth and thus has excellent stretchability and flame retardancy. Such textile products include firefighter clothes, fireproof clothes, office clothes, racing suits for motor sports, work clothes, gloves, hats, bests, and various industrial materials (sheets, tents, film materials, hoods, construction materials, housing materials, car interior materials, etc.). In addition, the work clothes mentioned above include work clothes for activities in a steel plant or steel factory, work clothes for welding, and work clothes in an explosion-proof area. In addition, the gloves mentioned above include work gloves used in the aircraft industry, the information equipment industry, the precision machinery industry, and the like where precision components are treated.

EXAMPLES

Next, examples of the invention and comparative examples will be described in detail, but the invention is not limited thereto. Incidentally, measurement items in the Examples were measured by the following methods.

(1) Flame Retardancy

Limiting oxygen index (LOI) was measured in accordance with JIS K7201: 1999 (Polymer Material Burning Test Method by Oxygen Index Method) and used as an index of flame retardancy.

(2) Stretchability

Elongation and elongation recovery were measured in accordance with JIS L1096: 2011 (B Method, constant load).

(3) Flammability

Afterflame time, afterglow time, and char length were measured in accordance with JIS L1091, A-4 Method, Appendix 8, and used as indexes of flammability.

Example 1

As a spun yarn, in the spinning process, a short fiber made of a polymetaphenylene isophthalamide fiber having a single-fiber fineness of 2.2 dtex, a cut length (fiber length) of 51 mm, and an LOI of 33 ("Conex"™ manufactured by Teijin Limited) and a short fiber made of a co-paraphenylene/3,4'-oxydiphenylene terephthalamide fiber having a single-fiber fineness of 1.7 dtex, a cut length (fiber length) of 51 mm, and an LOI of 25 ("Technora"™ manufactured by Teijin Limited) were spun together in a weight ratio (former: latter) of 95:5 to give a single yarn of English cotton count No. 40. The number of twists was 20.87 T/2.54 cm (twist coefficient=3.3).

Meanwhile, as a conjugate fiber, a multifilament (long fiber) made of two kinds of polytrimethylene terephthalate with different intrinsic viscosities put together in an eccentric sheath-core manner and having a total fineness of 40 dtex/24 fil, an elongation of 26%, and a boiling water shrinkage of 55.0% was prepared.

Next, two of the spun yarns were combined and second-twisted using a double twister. The number of twists was 20.9 T/2.54 cm. Subsequently, the yarns were twist-set using a vacuum steam setter at a setting temperature of 120° C. for a setting time of 20 minutes, thereby giving a flame-retardant plied yarn A.

In addition, two of the spun yarns and one of the conjugate fiber (multifilament) were combined and second-twisted using a double twister. The number of twists was 19.8 T/2.54 cm. Subsequently, the yarns were twist-set using a vacuum steam setter at a setting temperature of 80° C. for a setting time of 20 minutes, thereby giving a composite yarn B.

Next, 100% using the flame-retardant plied yarn A as the warp and 100% using the composite yarn B as the weft, they were plain-woven at a weaving density of warp: 48 yarns/2.54 cm and weft: 48 yarns/2.54 cm.

The formed woven fabric was finished through scouring, relaxing, and setting (temperature: 190° C.×time: 30 seconds). Here, when the relaxing temperature was 95° C., and a relatively strong rubbing effect was given, crimps of the conjugate fiber were developed well, and stretchability was developed particularly well.

In the obtained stretchy flame-retardant woven fabric, the weaving density was warp: 55 yarns/2.54 cm and weft: 48 yarns/2.54 cm, the non-flame-retardant fiber weight proportion was 6.0 wt %, and the limiting oxygen index was 29.0. The weft elongation was 7.0%, indicating excellent stretchability, and the elongation recovery was 75%. Evaluation results are shown in Table 1.

Next, work clothes were obtained using the stretchy flame-retardant woven fabric. As a result, they had excellent stretchability and flame retardancy.

Example 2

As a spun yarn, in the spinning process, a short fiber made of a polymetaphenylene isophthalamide fiber having a single-fiber fineness of 2.2 dtex, a cut length (fiber length) of 51 mm, and an LOI of 33 ("Conex"™ manufactured by Teijin Limited), a short fiber made of a co-paraphenylene/3,4'-oxydiphenylene terephthalamide fiber having a single-fiber fineness of 1.7 dtex, a cut length (fiber length) of 51 mm, and an LOI of 25 ("Technora"™ manufactured by Teijin Limited), and a short fiber made of a polyethylene terephthalate fiber having a single-fiber fineness of 1.7 dtex, a cut length (fiber length) of 51 mm, and an LOI of 21 (manufactured by Teijin Limited) were spun together in a weight ratio (in this order) of 80:5:15 to give a single yarn of English cotton count No. 40. The number of twists was 20.87 T/2.54 cm (twist coefficient=3.3). The procedure was otherwise the same as in Example 1. Evaluation results are shown in Table 1.

Example 3

The same procedure as in Example 1 was performed, except for using, as a conjugate fiber, a multifilament (long fiber) made of two kinds of polytrimethylene terephthalate with different intrinsic viscosities put together in an eccentric sheath-core manner and having a total fineness of 84 dtex/24 fil, an elongation of 41%, and a boiling water shrinkage of 42.0%. Evaluation results are shown in Table 1.

Example 4

Using the same composite yarn B as in Example 1 alone, a knitted fabric was formed using a 20-gauge single-bed knitting machine, then scoured, and finished. Evaluation results are shown in Table 1.

Comparative Example 1

The same procedure as in Example 1 was performed, except that the composite yarn B was not used, and that the flame-retardant plied yarn A was 100% used as the warp and weft for weaving. Evaluation results are shown in Table 2.

Comparative Example 2

As a spun yarn, in the spinning process, a short fiber made of a polymetaphenylene isophthalamide fiber having a single-fiber fineness of 2.2 dtex, a cut length (fiber length) of 51 mm, and an LOI of 33 ("Conex"™ manufactured by Teijin Limited), a short fiber made of a co-paraphenylene/3,4'-oxydiphenylene terephthalamide fiber having a single-fiber fineness of 1.7 dtex, a cut length (fiber length) of 51 mm, and an LOI of 25 ("Technora"™ manufactured by Teijin Limited), and a short fiber made of a polyethylene terephthalate fiber having a single-fiber fineness of 1.7 dtex, a cut length (fiber length) of 51 mm, and an LOI of 21 (manufactured by Teijin Limited) were spun together in a weight ratio (in this order) of 70:5:25 to give a single yarn of English cotton count No. 40. The number of twists was 20.87 T/2.54 cm (twist coefficient=3.3). The procedure was otherwise the same as in Example 2. Evaluation results are shown in Table 2.

Comparative Example 3

The same procedure as in Example 1 was performed, except for using, as a conjugate fiber, a multifilament (long fiber) made of two kinds of polytrimethylene terephthalate with different intrinsic viscosities put together in an eccentric sheath-core manner and having a total fineness of 165 dtex/24 fil, an elongation of 41%, and a boiling water shrinkage of 42.0%. Evaluation results are shown in Table 2.

Comparative Example 4

A knitted fabric was formed 100% using the composite yarn obtained in Comparative Example 3 using a 20-gauge single-bed knitting machine, then scoured, and finished. Evaluation results are shown in Table 2.

TABLE 1

| | | | Example 1 | Example 2 | Example 3 | Example 4 |
|---|---|---|---|---|---|---|
| Flame-Retardant | Conex ™ | | 88.9 | 74.9 | 83.2 | 83.5 |
| Fiber Proportion (%) | Technora ™ | | 4.7 | 4.7 | 4.4 | 4.4 |
| Non-Flame-Retardant | Conjugate fiber | | 6.4 | 6.4 | 12.4 | 12.1 |
| Fiber Proportion (%) | Polyester short fiber | | 0 | 14.0 | 0 | 0 |
| Form | Cloth form | | Woven fabric | Woven fabric | Woven fabric | Knitted fabric |
| Stretchability | Elongation | (%) | 7.0 | 7.0 | 12.0 | 13.0 |
| | Elongation Recovery | (%) | 75 | 75 | 83 | 73 |
| Flame Retardancy | Limiting Oxygen Index | — | 30 | 28 | 28 | 26 |
| Flammability | A-4 Method | Afterflame time (sec) | 0 | 0.8 | 1.0 | 1.0 |
| | | Afterglow time (sec) | 0 | 0.8 | 1.0 | 1.0 |
| | | Char length (cm) | 3.5 | 6.4 | 7.0 | 7.2 |

TABLE 2

| | | | Comparative Example 1 | Comparative Example 2 | Comparative Example 3 | Comparative Example 4 |
|---|---|---|---|---|---|---|
| Flame-Retardant Fiber Proportion (%) | Conex ™ | | 95.0 | 65.5 | 74.1 | 60.5 |
| | Technora ™ | | 5.0 | 4.7 | 3.9 | 3.2 |
| Non-Flame-Retardant Fiber Proportion (%) | Conjugate fiber | | 0 | 6.4 | 22.0 | 36.3 |
| | Polyester short fiber | | 0 | 23.4 | 0 | 0 |
| Form | Cloth form | | Woven fabric | Woven fabric | Woven fabric | Knitted fabric |
| Stretchability | Elongation | (%) | 1.3 | 7.0 | 12.0 | 20.0 |
| | Elongation Recovery | (%) | 90 | 75 | 83 | 80 |
| Flame Retardancy | Limiting Oxygen Index | — | 32 | 23 | 23 | 22.5 |
| Flammability | A-4 Method | Afterflame time (sec) | 0 | — | — | — |
| | | Afterglow time (sec) | 0 | — | — | — |
| | | Char length | 5.0 | All burned | All burned | All burned |

INDUSTRIAL APPLICABILITY

The invention provides a cloth that is excellent in terms of not only flame retardancy but also stretchability, and also a textile product using the cloth. The industrial value thereof is extremely high.

The invention claimed is:

1. A cloth comprising a composite yarn including:

a spun yarn that contains a flame-retardant fiber having a limiting oxygen index of 25 or more; and a conjugate fiber that is made of two components put together in a side-by-side manner or an eccentric sheath-core manner, the cloth being characterized in that the weight proportion of the flame-retardant fiber is 75 wt % or more based on the weight of the cloth, and the weight proportion of the conjugate fiber is within a range of 5 to 15 wt % based on the weight of the cloth.

2. The cloth according to claim 1, wherein the flame-retardant fiber is at least one fiber selected from the group consisting of meta-aramid fibers, para-aramid fibers, poly-paraphenylene benzoxazole fibers, polybenzimidazole fibers, polyimide fibers, polyetherimide fibers, polyamideimide fibers, carbon fibers, polyphenylene sulfide fibers, polyvinyl chloride fibers, flame-retardant rayon, modacrylic fibers, flame-retardant acrylic fibers, flame-retardant polyester fibers, flame-retardant vinylon fibers, melamine fibers, fluorine fibers, flame-retardant wool, and flame-retardant cotton.

3. The cloth according to claim 1, wherein the spun yarn further contains at least one fiber selected from the group consisting of polyester fibers, nylon fibers, rayon fibers, polynosic fibers, lyocell fibers, acrylic fibers, vinylon fibers, cotton, hemp, and wool.

4. The cloth according to claim 1, wherein the spun yarn has a twist coefficient within a range of 2.5 to 4.5.

5. The cloth according to claim 1, wherein the two components forming the conjugate fiber are a combination selected from the group consisting of a combination of polytrimethylene terephthalate and polytrimethylene terephthalate, a combination of polytrimethylene terephthalate and polyethylene terephthalate, and a combination of polyethylene terephthalate and polyethylene terephthalate.

6. The cloth according to claim 1, wherein the conjugate fiber is a multifilament having a single-fiber fineness of 0.5 to 10.0 dtex and a total fineness of 20 to 200 dtex.

7. The cloth according to claim 1, wherein the composite yarn is a plied yarn or a covering yarn.

8. The cloth according to claim 1, wherein the cloth is a woven fabric or a knitted fabric.

9. The cloth according to claim 1, wherein the cloth is a woven fabric, and one of the warp and weft of the woven fabric includes the composite yarn including a spun yarn that contains a flame-retardant fiber having a limiting oxygen index of 25 or more and a conjugate fiber that is made of two components put together in a side-by-side manner or an eccentric sheath-core manner, while the other includes a spun yarn that contains a flame-retardant fiber having a limiting oxygen index of 25 or more.

10. The cloth according to claim 1, wherein the cloth has an elongation within a range of 3 to 50% in the warp direction and/or weft direction.

11. The cloth according to claim 1, wherein the cloth has an elongation recovery of 70% or more in the warp direction and/or weft direction.

12. The cloth according to claim 1, wherein the cloth has a limiting oxygen index of 25 or more.

13. A textile product comprising the cloth according to claim 1.

* * * * *